US011485599B2

(12) United States Patent
Yamada

(10) Patent No.: US 11,485,599 B2
(45) Date of Patent: Nov. 1, 2022

(54) IMAGE FORMING SYSTEM AND STACKING APPARATUS

(71) Applicant: Konica Minolta, Inc., Tokyo (JP)

(72) Inventor: Kenichi Yamada, Higashiyamato (JP)

(73) Assignee: KONICA MINOLTA, INC., Tokyo (JP)

( * ) Notice: Subject to any disclaimer, the term of this patent is extended or adjusted under 35 U.S.C. 154(b) by 204 days.

(21) Appl. No.: 16/822,253

(22) Filed: Mar. 18, 2020

(65) Prior Publication Data

US 2020/0299094 A1 Sep. 24, 2020

(30) Foreign Application Priority Data

Mar. 19, 2019 (JP) ..... JP2019-051422

(51) Int. Cl.

| | |
|---|---|
| ***B65H 43/06*** | (2006.01) |
| ***B65H 31/10*** | (2006.01) |
| ***B65H 43/00*** | (2006.01) |
| ***G03G 15/00*** | (2006.01) |

(52) U.S. Cl.

CPC ..... *B65H 31/10* (2013.01); *B65H 43/00* (2013.01); *G03G 15/6529* (2013.01)

(58) Field of Classification Search

CPC ..... B65H 31/10; B65H 31/18; B65H 31/04; B65H 31/08; B65H 31/32; B65H 31/30; B65H 31/3054; B65H 43/00; B65H 43/02; B65H 43/06; B65H 43/08; G03G 15/6529

See application file for complete search history.

(56) References Cited

U.S. PATENT DOCUMENTS

2016/0052320 A1* 2/2016 Mutsuno ..... B65H 43/06 700/219
2018/0334349 A1* 11/2018 Miyahara ..... B65H 43/06

FOREIGN PATENT DOCUMENTS

JP 2010189148 A 9/2010
JP 2016043629 A 4/2016

OTHER PUBLICATIONS

JPO Notice for Reasons for Refusal for corresponding JP Application No. 2019-051422, dated Sep. 13, 2022.

* cited by examiner

*Primary Examiner* — Luis A Gonzalez
(74) *Attorney, Agent, or Firm* — Cantor Colburn LLP

(57) ABSTRACT

An image forming system includes: an image former that forms an image; a stacker that stacks a recording medium on which an image has been formed by the image former and which has been discharged from the image former; a lifter that raises or lowers the stacker between a stacking position where the recording medium is stacked and a lower position located below the stacking position; a recording medium detector that detects the recording medium stacked on the stacker; and a hardware processor that controls driving of the lifter so as to lower the stacker from the stacking position to the lower position when it is determined that the recording medium is on the stacker on the basis of a detection result of the recording medium detector within start-up time from a time when power is switched on to a time of shifting to an image formable state.

18 Claims, 10 Drawing Sheets

IMAGE FORMING SYSTEM AND STACKING APPARATUS

The present invention claims priority under 35 U.S.C. § 119 to Japanese Patent Application No. 2019-051422, filed on Mar. 19, 2019, the entire content of which is incorporated herein by reference.

BACKGROUND

Technological Field

The present disclosure relates to an image forming system and a stacking apparatus.

Description of the Related Art

JP 2010-189148 A discloses an image forming system including an image forming apparatus and a stacking apparatus that stacks a recording medium on which an image has been formed by the image forming apparatus. Regarding the image forming system, JP 2010-189148 A discloses that when power is switched off, a tray (stacker) on which a recording medium is stacked is lowered and the recording medium can be taken out from the apparatus, and then the power is switched off.

However, in the related art described in JP 2010-189148 A, when a trouble such as a power failure occurs and power is switched off, the stacker is not lowered, and therefore a user cannot take out the recording medium. Therefore, a user may forget to take out the recording medium from the stacker.

SUMMARY

The present invention has been achieved in view of such circumstances, and an object of the present invention is to provide an image forming system and a stacking apparatus that can prevent a user from forgetting to take a recording medium even when power is switched off due to a trouble such as a power failure and the recording medium remains in the stacker.

To achieve the abovementioned object, according to an aspect of the present invention, an image forming system reflecting one aspect of the present invention comprises: an image former that forms an image; a stacker that stacks a recording medium on which an image has been formed by the image former and which has been discharged from the image former; a lifter that raises or lowers the stacker between a stacking position where the recording medium is stacked and a lower position located below the stacking position; a recording medium detector that detects the recording medium stacked on the stacker; and a hardware processor that controls driving of the lifter so as to lower the stacker from the stacking position to the lower position when it is determined that the recording medium is on the stacker on the basis of a detection result of the recording medium detector within start-up time from a time when power is switched on to a time of shifting to an image formable state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
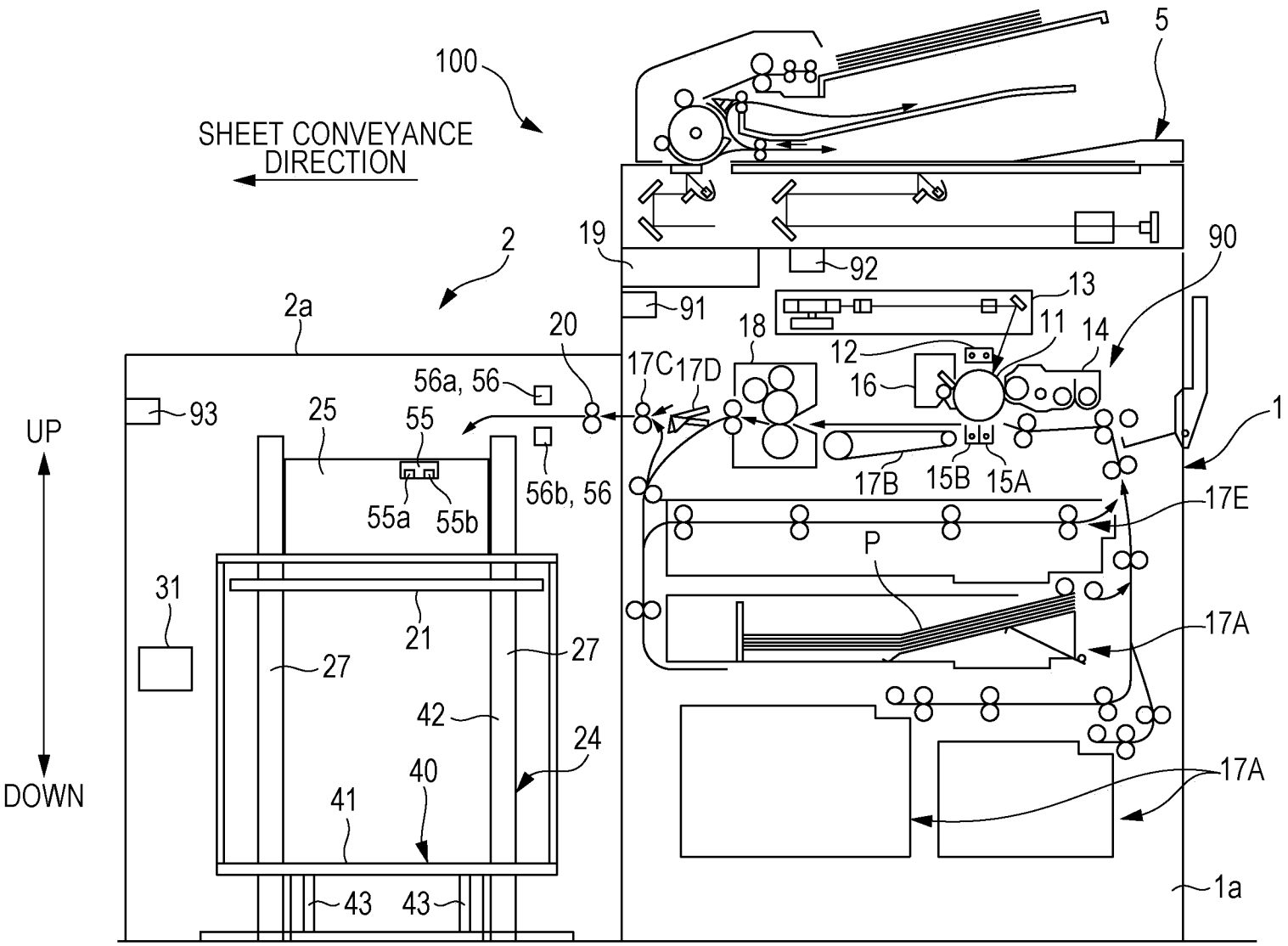
FIG. 1 is a front view schematically illustrating a configuration of an image forming system according to a first embodiment.
Figure 2A:
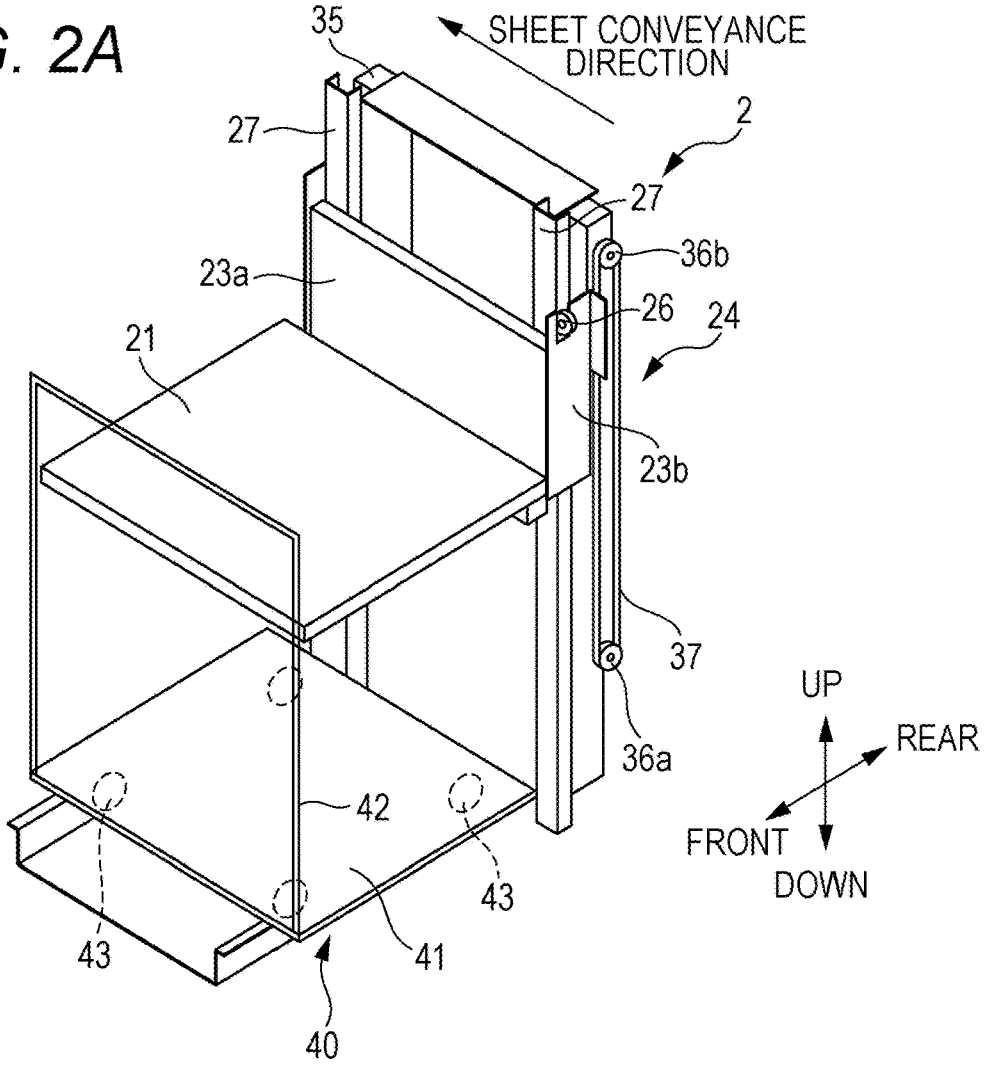
FIG. 2A is a configuration view illustrating a main part of a stacking apparatus mainly including a first tray and a carriage.

FIG. 1 is a front view schematically illustrating a configuration of an image forming system 100 according to the present embodiment. FIG. 2A is a configuration view illustrating a main part of a stacking apparatus 2 mainly including a first tray 21 and a carriage 40. The image forming system 100 according to the present embodiment includes an image forming apparatus 1 and the stacking apparatus 2.

[Image Forming Apparatus]

The image forming apparatus 1 is an electrophotographic image forming apparatus such as a copying machine, and forms an image on a sheet P (recording medium) on the basis of image data. The image forming apparatus 1 includes a document reader 5, a photoreceptor 11, a charger 12, an image exposing unit 13, a developing unit 14, a sheet cassette 17A, a transfer unit 15A, a separating unit 15B, a cleaner 16, an intermediate conveyance unit 17B, a fixing device 18, a sheet discharge roller 17C, a conveyance path switching plate 17D, a reverse conveyance unit 17E, an image forming controller 19 (controller), a power switch 91 (power), and a power button 92 (power).

The document reader 5 is disposed in an upper portion of a housing 1*a* of the image forming apparatus 1, and includes an automatic document feeder that automatically moves a document when an image is read. The document reader 5 reads an image formed on a document and outputs a predetermined image signal. The output image signal is subjected to A/D conversion, and is thereby created as image data. An image reading controller (not illustrated) included in the document reader 5 performs processing such as shading correction, dither processing, or compression on the image data, and outputs data obtained by this processing as final image data to the image forming controller 19.

The photoreceptor 11 carries an electrostatic latent image with the charger 12 and the image exposing unit 13 described later, and carries a toner image with toner of the developing unit 14 described later. The charger 12 uniformly charges a surface of the photoreceptor 11. The image exposing unit 13 scans and exposes the surface of the photoreceptor 11 with a laser beam on the basis of output information output from the image forming controller 19 described later on the basis of the image data, and forms an electrostatic latent image. The developing unit 14 develops the electrostatic latent image on the surface of the photoreceptor 11 with toner to form a toner image.

The sheet cassette 17A stores a sheet P. The transfer unit 15A transfers the toner image on the surface of the photoreceptor 11 onto a sheet P fed from the sheet cassette 17A to the transfer unit 15A. The separating unit 15B separates a sheet P onto which a toner image has been transferred from the photoreceptor 11. The cleaner 16 removes toner remaining on the surface of the photoreceptor 11 after a toner image is transferred onto a sheet P. The intermediate conveyance unit 17B conveys a separated sheet P to the fixing device 18.

The fixing device 18 performs a fixing process for fixing an image to a sheet P by heating and pressing. The sheet discharge roller 17C discharges a sheet P that has been subjected to the fixing process to the outside of the housing 1*a*.

When image formation is performed on both sides of a sheet P, the conveyance path switching plate 17D switches a conveyance direction of the sheet P that has been subjected to the fixing process by the fixing device 18 from the sheet discharge roller 17C side to a lower (reverse conveyance unit 17E) side. The reverse conveyance unit 17E inverts the front and back of a sheet P by switching back the sheet P, and then conveys the sheet P to the transfer unit 15A.

The image forming controller 19 controls the image forming apparatus 1. As the image forming controller 19, a microcomputer mainly including a CPU, a ROM, a RAM, and an I/O interface can be used. The CPU executes various programs (processor). The ROM stores various programs executed by the CPU in a form of program codes readable by the CPU. The ROM stores data necessary for executing a program. The RAM is a memory serving as a working storage area. When the program and data stored in the ROM are read by the CPU, the program and data are developed on the RAM. Then, the CPU performs various processes on the basis of the program and data developed on the RAM. The function of the image forming controller 19 will be described in detail later.

The power switch 91 is a main power and keeps the image forming apparatus 1 in an operating state all the times. If the power switch 91 is turned on, the image forming apparatus 1 can receive FAX information and form an image, or can receive data from a personal computer and form an image.

The power button 92 is pressed in order to shift the image forming apparatus 1 to a sleep state or to release the sleep state to shift the image forming apparatus 1 to a standby state. The power button 92 can shift the stacking apparatus 2 to a sleep state, or can release the sleep state to shift the stacking apparatus 2 to a standby state in addition to the image forming apparatus 1.

When the power switch 91 is switched from off to on and the power button 92 is switched from off to on, the power of the image forming apparatus 1 is switched on. For example, when a user presses the power switch 91 with a finger to switch the power switch 91 from off to on, and then the user presses the power button 92 with a finger to switch the power button 92 from off to on, the power of the image forming apparatus 1 is switched on. The power switch 91 is pressed so as to be on but the power switch 91 is turned off due to a power failure, and a user presses the power button 92 with a finger to switch the power button 92 from off to on after the power failure is over and the power switch 91 is turned on. As a result, the power of the image forming apparatus 1 is switched on.

The power of the image forming apparatus 1 is switched off by switching the power switch 91 from on to off or switching the power button 92 from on to off

[Stacking Apparatus]

The stacking apparatus 2 stacks and stores a sheet P fed from the image forming apparatus 1 when the sheet P is taken into a housing 2*a* (stacking apparatus main body). The stacking apparatus 2 is disposed on a downstream side of the image forming apparatus 1 in a sheet conveyance direction so as to be adjacent to the image forming apparatus 1. The stacking apparatus 2 includes a sheet discharge unit 20, a first tray 21 (stacker), a sheet detector 55 (recording medium detector), a stacking amount detector 56, a lifting device 24 (lifter), a carriage 40, a stacking controller 31 (controller), and a power switch 93 (power).

The sheet discharge unit 20 is formed of a pair of rollers that receives a sheet P fed from the image forming apparatus 1, takes the sheet P into the housing 2*a* of the stacking apparatus 2, and discharges the sheet P to the first tray 21. The position of the sheet discharge unit 20 is set so as to correspond to the sheet discharge roller 17C of the image forming apparatus 1.

[First Tray]

On the first tray 21, a sheet P on which an image has been formed by the image forming apparatus 1 and which has been discharged from the image forming apparatus 1 is stacked. The first tray 21 is a flat plate-like member having a horizontal plane, and receives a sheet P on the horizontal plane.

[Sheet Detector]

The sheet detector 55 detects a sheet P stacked on the first tray 21 and is a sensor disposed above the first tray 21. For the sheet detector 55, for example, a photo reflector is used. The sheet detector 55 includes a light emitting unit 55*a* and a light receiving unit 55*b*.

Figure 2B:
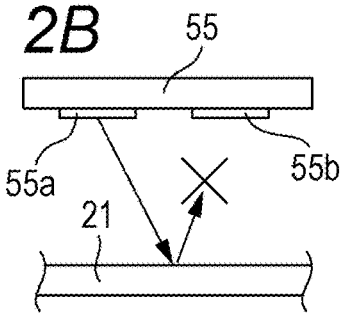
FIG. 2B is an explanatory diagram for explaining a state where a sheet detector does not detect a sheet.

For example, as illustrated in FIG. 2B, when a sheet P is not disposed on the first tray 21, light emitted from the light emitting unit 55*a* is absorbed by the first tray 21 and does not reach the light receiving unit 55*b*. As a result, it is determined that a sheet P is not disposed on the first tray 21. As illustrated in FIG. 2C, when a sheet P is disposed on the first tray 21, light emitted from the light emitting unit 55*a* is reflected by the sheet P on the first tray 21 and reaches the light receiving unit 55*b*. As a result, it is determined that a sheet P is disposed on the first tray 21.

[Stacking Amount Detector]

The stacking amount detector 56 is a sensor that is disposed on a downstream side of the sheet discharge unit 20 in a sheet conveyance direction and is disposed on an upstream side of the first tray 21 in the sheet conveyance direction. For example, a photo sensor is used for the stacking amount detector 56. The stacking amount detector 56 includes a light emitting unit 56*a* and a light receiving unit 56*b*.

Figure 2D:
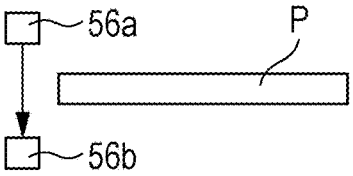
FIG. 2D is an explanatory diagram illustrating a state where a stacking amount detector does not detect a sheet.
Figure 2C:
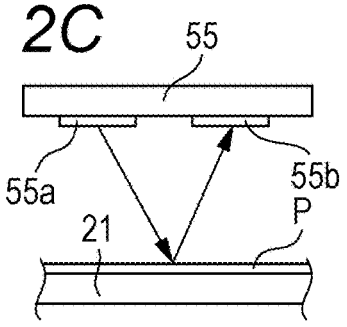
FIG. 2C is an explanatory diagram illustrating a state where the sheet detector detects a sheet.
Figure 2E:
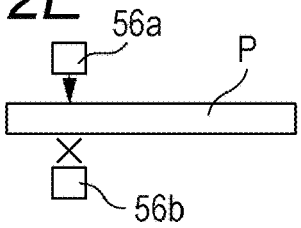
FIG. 2E is an explanatory diagram for explaining a state where the stacking amount detector detects a sheet.

For example, as illustrated in FIG. 2D, when a sheet P is not interposed between the light emitting unit 56*a* and the light receiving unit 56*b*, light emitted from the light emitting unit 56*a* reaches the light receiving unit 56*b*. As illustrated in FIG. 2E, when a sheet P is interposed between the light emitting unit 56*a* and the light receiving unit 56*b*, light emitted from the light emitting unit 56*a* is blocked by the sheet P and does not reach the light receiving unit 56*b*. Therefore, by counting the number of times light emitted from the light emitting unit 56*a* does not reach the light receiving unit 56*b* after the light emitted from the light emitting unit 56*a* reaches the light receiving unit 56*b*, the stacking amount (number of sheets) of sheets P stacked on the first tray 21 is detected.

[Lifting Device]

The lifting device 24 raises or lowers the first tray 21 between a stacking position L1 (see FIG. 5A) at which a sheet P is stacked and a lower position L2 (see FIG. 5B) located below the stacking position L1. Here, description is given with reference to FIG. 2A again. The lifting device 24 includes a base member 23*a*, a wheel support member 23*b*, a wheel 26, a guide 27, a frame 35, pulleys 36*a* and 36*b*, and a belt 37.

To the base member 23*a*, an end surface of the first tray 21 is fixed. The wheel support member 23*b* is fixed to the base member 23*a* and supports the wheel 26 rotatably. The wheel 26 can move in the vertical direction along the guide 27. Two guides 27 are disposed so as to extend in the vertical direction.

The frame 35 is disposed on the back side of the base member 23*a*. The pulley 36*a* is rotated by driving a motor (not illustrated), and is rotatably attached to the frame 35. The pulley 36*b* is rotatably attached to the frame 35. The belt 37 is stretched around the pulleys 36*a* and 36*b*.

[Carriage]

The carriage 40 includes a carrier 41, a handle 42, and a wheel 43. The carrier 41 is disposed below the first tray 21 and receives a sheet P stacked on the first tray 21 from the first tray 21. The handle 42 is attached to the carrier 41 and operated by a user.

[Stacking Controller]

The stacking controller 31 controls the stacking apparatus 2. As the stacking controller 31, a microcomputer mainly including a CPU, a ROM, a RAM, and an I/O interface can be used. The CPU executes various programs (processor). The ROM stores various programs executed by the CPU in a form of program codes readable by the CPU. The ROM stores data necessary for executing a program. The RAM is a memory serving as a working storage area. When the program and data stored in the ROM are read by the CPU, the program and data are developed on the RAM. Then, the CPU performs various processes on the basis of the program and data developed on the RAM.

The power switch 93 is a main power and keeps the stacking apparatus 2 in an operating state all the times. The power switch 93 is switched on or off, and the stacking apparatus 2 is thereby switched on or off.

[Power is Switched On]

Considering the power-on of the image forming apparatus 1 and the power-on of the stacking apparatus 2, the power of the image forming system 100 is switched on when the power switch 91 and the power switch 93 are switched on and the power button 92 is further switched on.

[Component Related to Lowering Control of First Tray Among Components of Image Forming Controller and Stacking Controller]

Figure 3:
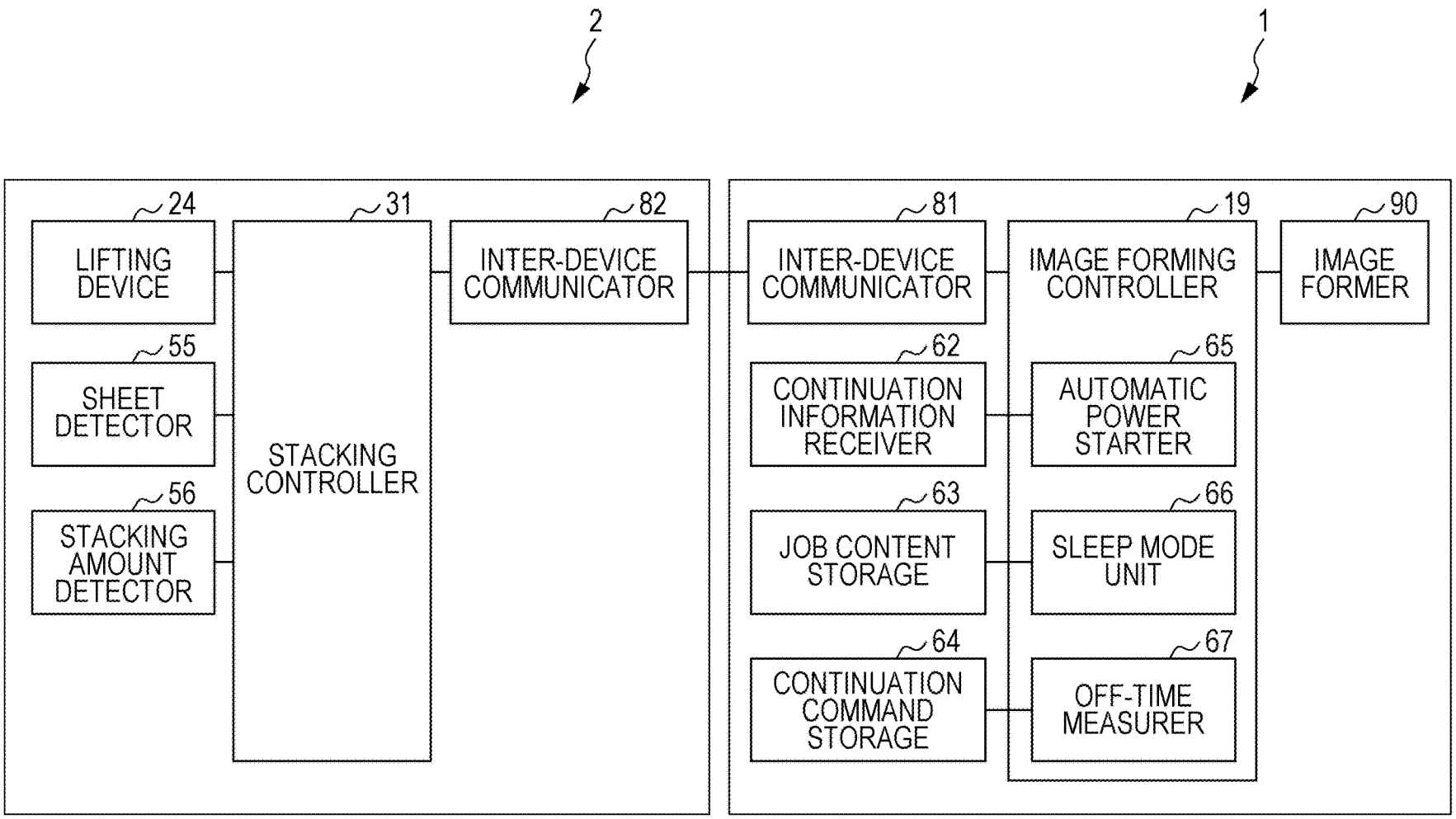
FIG. 3 is a block diagram of an image forming apparatus and the stacking apparatus.

FIG. 3 is a block diagram of the image forming apparatus 1 and the stacking apparatus 2. As illustrated in FIG. 3, the image forming controller 19 is connected to a continuation information receiver 62, a job content storage 63, a continuation command storage 64, an inter-device communicator 81, and an image former 90. The image forming controller 19 has a position fixing mode. The image forming controller 19 includes an automatic power starter 65 (automatic power-on unit), a sleep mode unit 66 (automatic power-off unit), and an off-time measurer 67.

The continuation information receiver 62 receives job continuation information indicating that a job executed before the power of the image forming apparatus 1 is switched from on to off continues when the power is next switched on. The job content storage 63 stores contents of a job before the image forming apparatus 1 is turned off. The continuation command storage 64 stores a command to continue a job stored in the job content storage 63 when the power is next switched on.

The inter-device communicator 81 is connected to the stacking controller 31 via an inter-device communicator 82 of the stacking apparatus 2. The image former 90 includes the above-described photoreceptor 11, charger 12, image exposing unit 13, developing unit 14, sheet cassette 17A, transfer unit 15A, separating unit 15B, cleaner 16, fixing device 18, and the like. The position fixing mode is a mode for a service person that controls driving of the lifting device 24 so as to keep the first tray 21 at the stacking position L1.

The automatic power starter 65 automatically switches on powers of the image forming apparatus 1 and the stacking apparatus 2 at a predetermined time. The automatic power starter 65 is connected in view of mechanism such that the power is turned on, but stops a current flow until a predetermined time, starts the current flow at the predetermined time, and switches on the powers of the image forming apparatus 1 and the stacking apparatus 2. As a result, the image forming apparatus 1 and the stacking apparatus 2 start.

The sleep mode unit 66 automatically switches off the power button 92 of the image forming apparatus 1 when there is no user operation for a predetermined time or more. The sleep mode unit 66 is operable when the power switch 91 is in an on state. In this state, when there is no user operation for a predetermined time or more, the sleep mode unit 66 switches the power button 92 from on to off and switches off the power of the image forming apparatus 1.

The off-time measurer 67 measures off-time from the time when the power of the image forming apparatus 1 is turned off to the time when the power is switched on.

[Control of Lowering First Tray Among Controls of Image Forming Controller and Stacking Controller]

The image forming controller 19 transmits information of being within start-up time to start the image forming system 100 to the stacking controller 31 via the inter-device communicators 81 and 82. The stacking controller 31 determines that a sheet P is on the first tray 21 on the basis of a detection result of the sheet detector 55 within the start-up time. In this case, the stacking controller 31 controls driving of the lifting device 24 so as to lower the first tray 21 from the stacking position L1 to the lower position L2.

The start-up time here refers to a period of time from the time when power is switched on to the time of shifting to an image formable state. The time when power is switched on is the time when the power switches 91 and 93 are switched on and the power button 92 is switched on as described above. The image formable state is a state where preparation for starting image formation such as initial driving is completed. The image forming controller 19 lowers the first tray 21 by controlling rotation of a motor (not illustrated) that drives the pulley 36*a*.

[Control that does not Lower First Tray Among Controls of Image Forming Controller and Stacking Controller]

It is assumed that the image forming controller 19 transmits job continuation information received by the continuation information receiver 62 to the stacking controller 31 via the inter-device communicators 81 and 82. In this case, the stacking controller 31 controls driving of the lifting device 24 so as to keep the first tray 21 at the stacking position L1.

It is assumed that the image forming controller 19 receives a signal that the continuation information receiver 62 stops the job after the power is switched on and transmits the signal to the stacking controller 31 via the inter-device communicators 81 and 82. In this case, the stacking controller 31 controls driving of the lifting device 24 so as to lower the first tray 21 from the stacking position L1 to the lower position L2.

It is assumed that the image forming controller 19 transmits setting information for automatically switching on powers of the image forming apparatus 1 and the stacking apparatus 2 included in the automatic power starter 65 at a predetermined time to the stacking controller 31 via the inter-device communicators 81 and 82. In this case, the stacking controller 31 controls driving of the lifting device 24 so as to keep the first tray 21 at the stacking position L1.

It is assumed that the image forming controller 19 transmits switching information indicating that the off state by the sleep mode unit 66 is released and the power is switched on to the stacking controller 31 via the inter-device communicators 81 and 82. In this case, the stacking controller 31 controls driving of the lifting device 24 so as to keep the first tray 21 at the stacking position L1.

It is assumed that the image forming controller 19 receives that off-time measured by the off-time measurer 67 is a predetermined time or less as information and transmits the information to the stacking controller 31 via the inter-device communicators 81 and 82. In this case, the stacking controller 31 controls driving of the lifting device 24 so as to keep the first tray 21 at the stacking position L1.

It is assumed that the image forming controller 19 transmits selection information of a position fixing mode to the stacking controller 31 via the inter-device communicators 81 and 82 when the position fixing mode is selected. In this case, the stacking controller 31 controls driving of the lifting device 24 so as to keep the first tray 21 at the stacking position L1 even when the power is switched on.

It is assumed that the stacking controller 31 determines that the stacking amount of sheets P on the first tray 21 is a predetermined amount or less on the basis of a detection result of the stacking amount detector 56. In this case, the stacking controller 31 controls driving of the lifting device 24 so as to keep the first tray 21 at the stacking position L1.

The stacking controller 31 determines whether the carriage 40 is disposed below the first tray 21. The stacking controller 31 does not drive the lifting device 24 when the carriage 40 is not disposed. When the carriage 40 is disposed, the stacking controller 31 controls driving of the lifting device 24 such that the first tray 21 is lowered to the lower position and the carriage 40 receives a sheet P.

[Control of First Tray by Stacking Controller]

As illustrated in FIG. 3, the stacking controller 31 is connected to the lifting device 24, the sheet detector 55, the stacking amount detector 56, and the inter-device communicator 82. The stacking controller 31 controls driving of the lifting device 24 such that the first tray 21 is disposed at the stacking position L1 while a sheet P on which an image has been formed is discharged from the image forming apparatus 1. When a sheet P is discharged from the sheet discharge unit 20, the stacking controller 31 controls driving of the lifting device 24 so as to lower (move) the first tray 21 such that an uppermost sheet P stacked on the first tray 21 maintains a predetermined height.

The stacking position L1 of the first tray 21 here is a home position L10 (see FIG. 5A) of the first tray 21 when stacking of a sheet P is started in a case where no sheet P is disposed on the first tray 21. The stacking position L1 of the first tray 21 is a stacking intermediate position L11 (see FIG. 5A) of the first tray 21 when the position of an uppermost surface of sheets P is set to the position of the first tray 21 at the time of start of stacking the sheets P in a case where the number of sheets P set by a user are disposed on the first tray 21. Therefore, the stacking position L1 corresponds to a position from the home position L10 of the first tray 21 when no sheet P is stacked on the first tray 21 to the stacking intermediate position L11 of the first tray 21 when the set number of sheets P are stacked on the first tray 21.

When the number of sheets P stacked on the first tray 21 reaches the set number, the lifting device 24 lowers the first tray 21 to the lower position L2 where the sheets P can be taken out with respect to the carriage 40. When the sheets P are completely taken out from the first tray 21 to the carriage 40, the lifting device 24 raises the first tray 21 from the lower position L2 to the home position L10.

Figure 4:
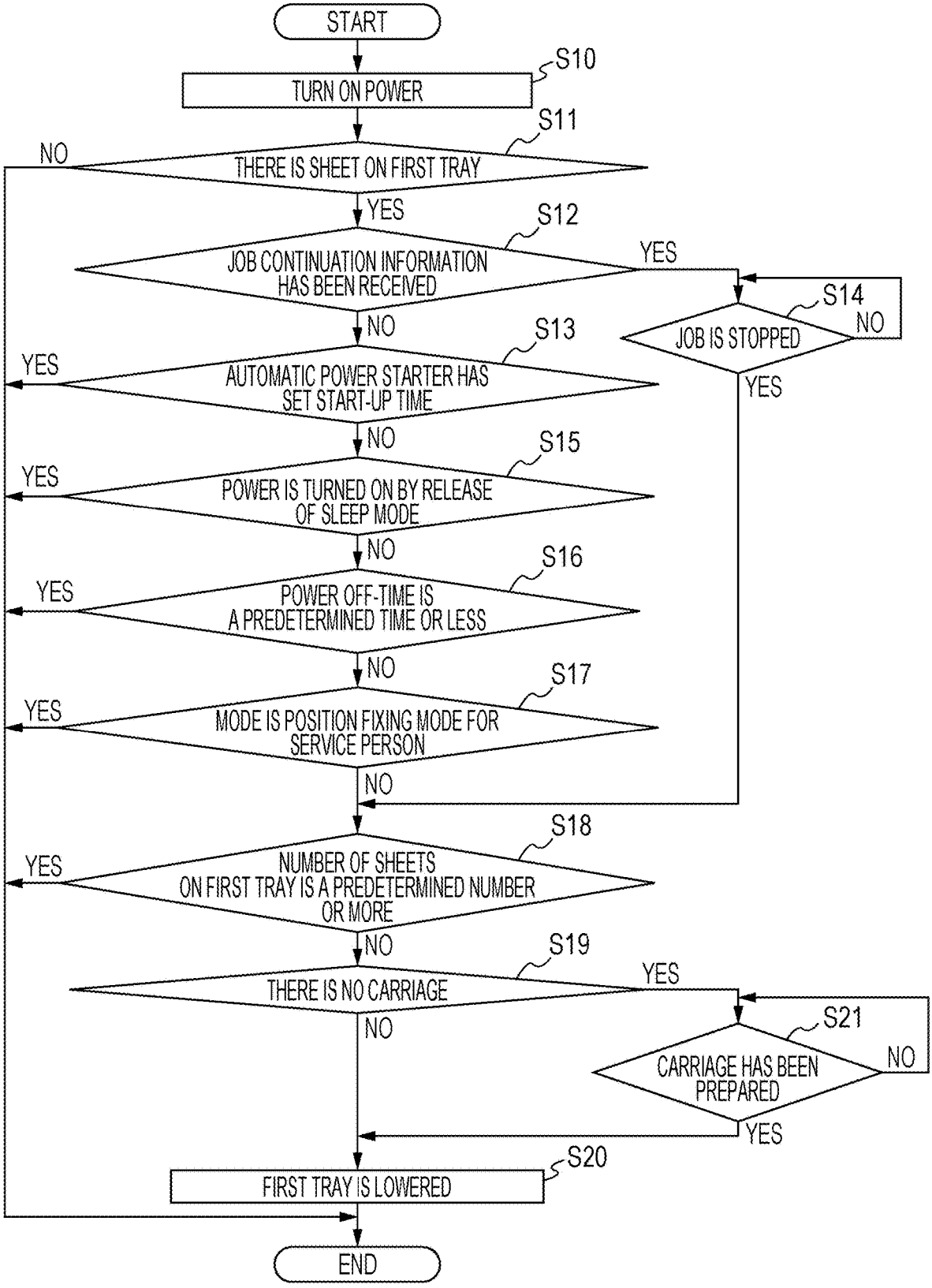
FIG. 4 is a flowchart illustrating a flow of control of a stacker within start-up time.

Hereinafter, operation of the image forming system 100 according to the present embodiment will be described. Here, FIG. 4 is a flowchart illustrating a flow of control of the first tray 21 within start-up time. FIGS. 5A to 5D are explanatory diagrams for explaining a flow of operation of the first tray 21. The processing illustrated in this flowchart is executed by the image forming controller 19 and the stacking controller 31 with a user's print start command as a trigger.

First, in step S10, a user turns on powers of the image forming apparatus 1 and the stacking apparatus 2. The image forming controller 19 starts devices in the image forming apparatus 1 and the stacking apparatus 2 within start-up time from the time when powers of the image forming apparatus 1 and the stacking apparatus 2 are switched on to the time when the image forming apparatus 1 is shifted to an image formable state.

In step S11, the stacking controller 31 determines whether there is a sheet P on the first tray 21 on the basis of a detection result of the sheet detector 55. If there is a sheet P on the first tray 21, an affirmative determination is made in step S11, and the process proceeds to step S12. The sheet P on the first tray 21 was stacked on the first tray 21 when the power was previously turned on. Meanwhile, if there is no sheet P on the first tray 21, negative determination is made in step S11, and control within the start-up time is ended.

In step S12, the image forming controller 19 determines whether the continuation information receiver 62 has received job continuation information indicating that a job before power off is continued after the next power on. If the continuation information receiver 62 has received the job continuation information, an affirmative determination is made in step S12, and the process proceeds to step S14.

Meanwhile, if the continuation information receiver 62 has not received the job continuation information, a negative determination is made in step S12, and the process proceeds to step S13.

In step S13, the image forming controller 19 confirms whether the automatic power starter 65 has set power start-up time. If the start-up time has been set by the automatic power starter 65, an affirmative determination is made in step S13, and control within the start-up time is ended. Meanwhile, if the start-up time has not been set by the automatic power starter 65, a negative determination is made in step S13, and the process proceeds to step S15.

In step S14, if the continuation information receiver 62 has received the job continuation information, the image forming controller 19 determines whether a job stop signal for stopping the job received by the continuation information receiver 62 has been received. If the job stop signal has been received, an affirmative determination is made in step S14, and the process proceeds to step S18. Meanwhile, if the job stop signal has not been received, a negative determination is made in step S14, and the process returns to step S14.

In step S15, the image forming controller 19 confirms whether power (power button 92) has been turned on by release of the sleep mode by the sleep mode unit 66. If power (power button 92) has been turned on by release of the sleep mode, an affirmative determination is made in step S15, and control within the start-up time is ended. Meanwhile, if power (power button 92) has not been switched on by release of the sleep mode, a negative determination is made in step S15, and the process proceeds to step S16.

In step S16, the image forming controller 19 confirms that off-time measured by the off-time measurer 67 is a predetermined time or less. If the off-time is the predetermined time or less, an affirmative determination is made in step S16, and control within the start-up time is ended. Meanwhile, if the off-time is more than the predetermined time, a negative determination is made in step S16, and the process proceeds to step S17.

In step S17, the image forming controller 19 confirms whether the mode is a position fixing mode for a service person. If the mode is a position fixing mode for a service person, an affirmative determination is made in step S17, and control within the start-up time is ended. Meanwhile, if the mode is not a position fixing mode for a service person, a negative determination is made in step S17, and the process proceeds to step S18.

In step S18, the stacking controller 31 confirms whether the number of sheets P stacked on the first tray 21 detected by the sheet detector 55 is a predetermined number or more. If the stacking amount of sheets P on the first tray 21 is the predetermined number or more, an affirmative determination is made in step S18, and control within the start-up time is ended. Meanwhile, if the stacking amount of sheets P stacked on the first tray 21 is less than the predetermined number, a negative determination is made in step S18, and the process proceeds to step S19.

Figure 5A:
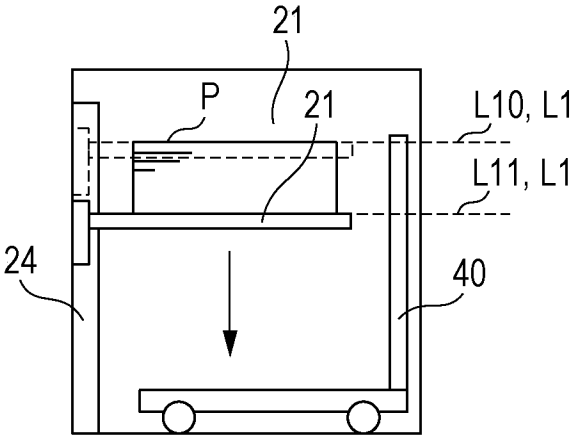
FIGS. 5A to 5D are explanatory diagrams for explaining a flow of operation of the stacker.

In step S19, the stacking controller 31 determines whether the carriage 40 is disposed below the first tray 21 (see FIG. 5A). If the carriage 40 is not disposed below the first tray 21, an affirmative determination is made in step S19, and the process proceeds to step S21. Meanwhile, if the carriage 40 is disposed below the first tray 21, a negative determination is made in step S19, and the process proceeds to step S20.

In step S20, the stacking controller 31 lowers the first tray 21 toward the carriage 40, and ends control within the start-up time.

Figure 5B:
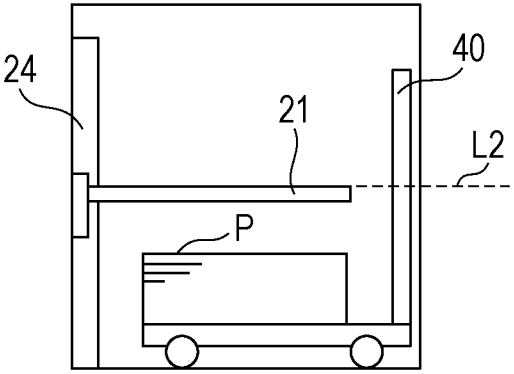
Figure 5C:
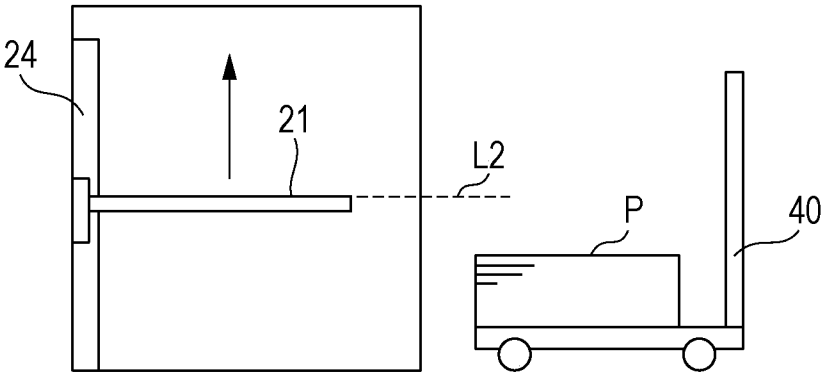
Figure 5D:
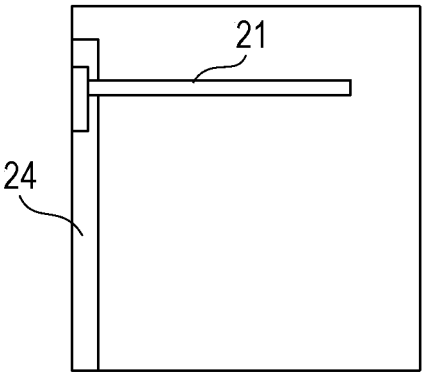

Thereafter, a user moves a sheet P on the first tray 21 onto the carriage 40 (see FIG. 5B). A user discharges the carriage 40 outside the image forming apparatus 1 (see FIG. 5C). When the carriage 40 is discharged outside the image forming apparatus 1, the stacking controller 31 raises the first tray 21 (see FIG. 5D). Thereafter, furthermore, the image forming controller 19 executes an image forming operation. By this image forming operation, a series of processes such as feeding of a sheet P, forming an image on a fed sheet P, and discharging a sheet P on which an image has been formed to the stacking apparatus 2 are performed. The stacking controller 31 controls driving of the sheet discharge unit 20, receives a sheet P fed from the image forming apparatus 1 in the sheet discharge unit 20, and discharges the sheet P to the first tray 21.

In step S21, the stacking controller 31 determines whether the carriage 40 is prepared. If the carriage 40 is prepared, an affirmative determination is made in step S21, and the process proceeds to step S20. If the carriage 40 is not prepared, a negative determination is made in step S21, and the process returns to step S21.

As described above, in the present embodiment, the image forming controller 19 recognizes a state within the start-up time from the time when power of the image forming apparatus 1 is switched on to the time when the image forming apparatus 1 is shifted to an image formable state. Within this start-up time, the stacking controller 31 controls driving of the lifting device 24 so as to lower the first tray 21 from the stacking position L1 to the lower position L2 when the sheet detector 55 detects a sheet P. This configuration can prevent a user from forgetting to take a sheet P even when power is switched off due to a trouble such as a power failure and the sheet P remains in the first tray 21. Immediately after power of the image forming system 100 is switched on, presence of a sheet P on the first tray 21 indicates that there is a high possibility that a user has forgotten to take the sheet P. Therefore, when the power is switched on, the first tray 21 is controlled so as to be automatically lowered to the lower position L2, and a user is urged to take out the sheet P.

In addition, the image forming system 100 includes the continuation information receiver 62 that receives job continuation information indicating that a job executed before the powers of the image forming apparatus 1 and the stacking apparatus 2 are switched from on to off continues when the powers are next switched on. The image forming controller 19 receives information indicating that the continuation information receiver 62 has received the job continuation information, and transmits the information to the stacking controller 31. The stacking controller 31 controls driving of the lifting device 24 so as to keep the first tray 21 at the stacking position L1. According to this configuration, when there is a job to be continued, the first tray 21 is not lowered to the lower position L2, but the job is continuously executed immediately. Therefore, convenience and productivity for a user are improved. For example, there is a case where a large number of jobs are output until 5:00 pm that is closing time, the power is turned off with work unfinished, and the power is turned on the next day at 9:00 am to continue output of the jobs. In this case, even if the power is switched on, the first tray 21 is not lowered, but the job is continued, which is convenient for a user The image forming controller 19 transmits the job stop information received by the continuation information receiver 62 to the stacking controller 31 after the power of the image forming apparatus 1 is switched on. The stacking controller 31 controls driving of the lifting device 24 so as to lower the first tray 21 to the lower position L2. According to this configuration, when there is no job to be output on the next day and to be continued, the first tray 21 is lowered to the lower position L2 where a sheet P is easily taken out even if there is no instruction to lower the first tray 21 by a user. Therefore, a user can be prevented from forgetting to take the sheet P The image forming system 100 also includes the automatic power starter 65 that automatically switches on the power of the image forming apparatus 1 at a predetermined time. The image forming controller 19 transmits switching information indicating that the power of the image forming apparatus 1 is turned on and set by the automatic power starter 65 to the stacking controller 31. The stacking controller 31 controls driving of the lifting device 24 so as to keep the first tray 21 at the stacking position L1. A user can use this configuration, for example, in a case where working hours of the user's company start at 9:00 am, when the user desires to set the image forming apparatus 1 such that the image forming apparatus 1 is automatically turned on 8:55 am by operating the automatic power starter 65. With this setting, the power is turned on immediately before the user's working hours and the image forming apparatus 1 is warmed up. Therefore, the user's standby time can be shortened. If the power is turned on at night when there is no user, confidentiality of information an image of which has been formed on a sheet P may be impaired. Therefore, confidentiality is maintained.

The image forming system 100 also includes the sleep mode unit 66 that automatically switches off the power (power button 92) of the image forming apparatus 1 when there is no user operation for a predetermined time or more. The image forming controller 19 transmits switching information indicating that the off state by the sleep mode unit 66 is released and the power (power button 92) is switched from off to on to the stacking controller 31. The stacking controller 31 controls driving of the lifting device 24 so as to keep the first tray 21 at the stacking position L1. According to this configuration, for example, a user can suppress a phenomenon that the first tray 21 is lowered every time the image forming apparatus 1 is released from the sleep mode. That is, in the sleep mode, a user does not intend to stop outputting a job for a long time in some cases. For this reason, the job is restored immediately after release of the sleep mode, and the job can be output, which is convenient for a user In addition, the image forming system 100 includes the off-time measurer 67 that measures off-time from the time when the power of the image forming apparatus 1 is turned off to the time when the power is switched on. The image forming controller 19 determines that the off-time measured by the off-time measurer 67 is a predetermined time or less. In this case, the stacking controller 31 controls driving of the lifting device 24 so as to keep the first tray 21 at the stacking position L1. According to this configuration, when the off-time is the predetermined time or less, there is a high possibility that a user has a weak intention (or no intention) to switch off the power. For this reason, the user can execute next image formation while the first tray 21 is not lowered to the lower position L2, which is convenient for a user The image forming controller 19 has a position fixing mode for a service person, the mode controlling driving of the lifting device 24 so as to keep the first tray 21 at the stacking position L1. According to this configuration, since the first tray 21 is not lowered to the lower position L2 every time powers of the image forming apparatus 1 and the stacking apparatus 2 are turned on, a service person can immediately perform maintenance work of the image forming system 100, which is convenient for a service person.

The sheet detector 55 detects the stacking amount of sheets P stacked on the first tray 21. When the stacking amount detected by the sheet detector 55 is a predetermined amount or less, the stacking controller 31 controls driving of the lifting device 24 so as to keep the first tray 21 at the stacking position L1. According to this configuration, when the stacking amount of sheets P is the predetermined amount or less, a user can take out a sheet P by himself/herself while the first tray 21 is not lowered to the lower position L2. For example, if the stacking amount of sheets P is 3000 sheets, the weight may exceed 70 kg, and it is difficult for a user to take out a bundle of sheets P manually. However, if the stacking amount of sheets P is small, a user can easily take out a bundle of sheets P manually. Since time and electric power are required for lowering the first tray 21, such time and electric power are reduced when the stacking amount of sheets P is small.

The stacking controller 31 determines whether the carriage 40 is disposed below the first tray 21. The stacking controller 31 does not drive the lifting device 24 when the carriage 40 is not disposed. The stacking controller 31 controls driving of the lifting device 24 such that the first tray 21 is lowered to the lower position and the carriage 40 receives a sheet P when the carriage 40 is disposed. According to this configuration, even if a user does not give an instruction to lower the first tray 21 after setting the carriage 40, the first tray 21 can be automatically lowered immediately.

Second Embodiment

Figure 6:
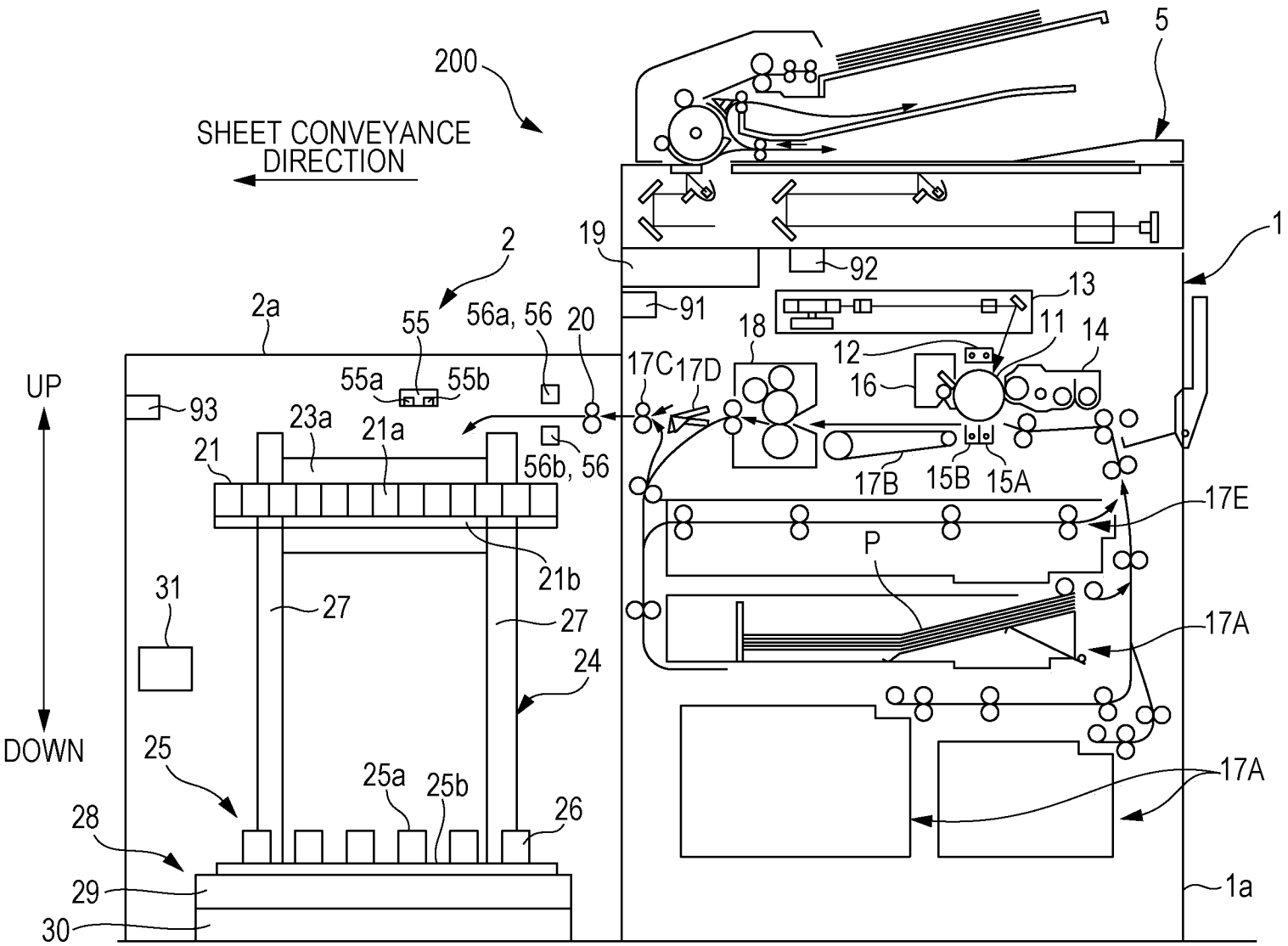
FIG. 6 is a front view schematically illustrating a configuration of an image forming system according to a second embodiment.

FIG. 6 is a front view schematically illustrating a configuration of an image forming system 200 according to a second embodiment. Hereinafter, the image forming system 200 according to the second embodiment will be described with reference to FIG. 6. The image forming system 200 according to the second embodiment is different from the image forming system 100 according to the first embodiment in the configuration of the stacking apparatus 2. Description overlapping with that of the first embodiment is omitted, and the following description will be focused on the difference.

Figure 7:
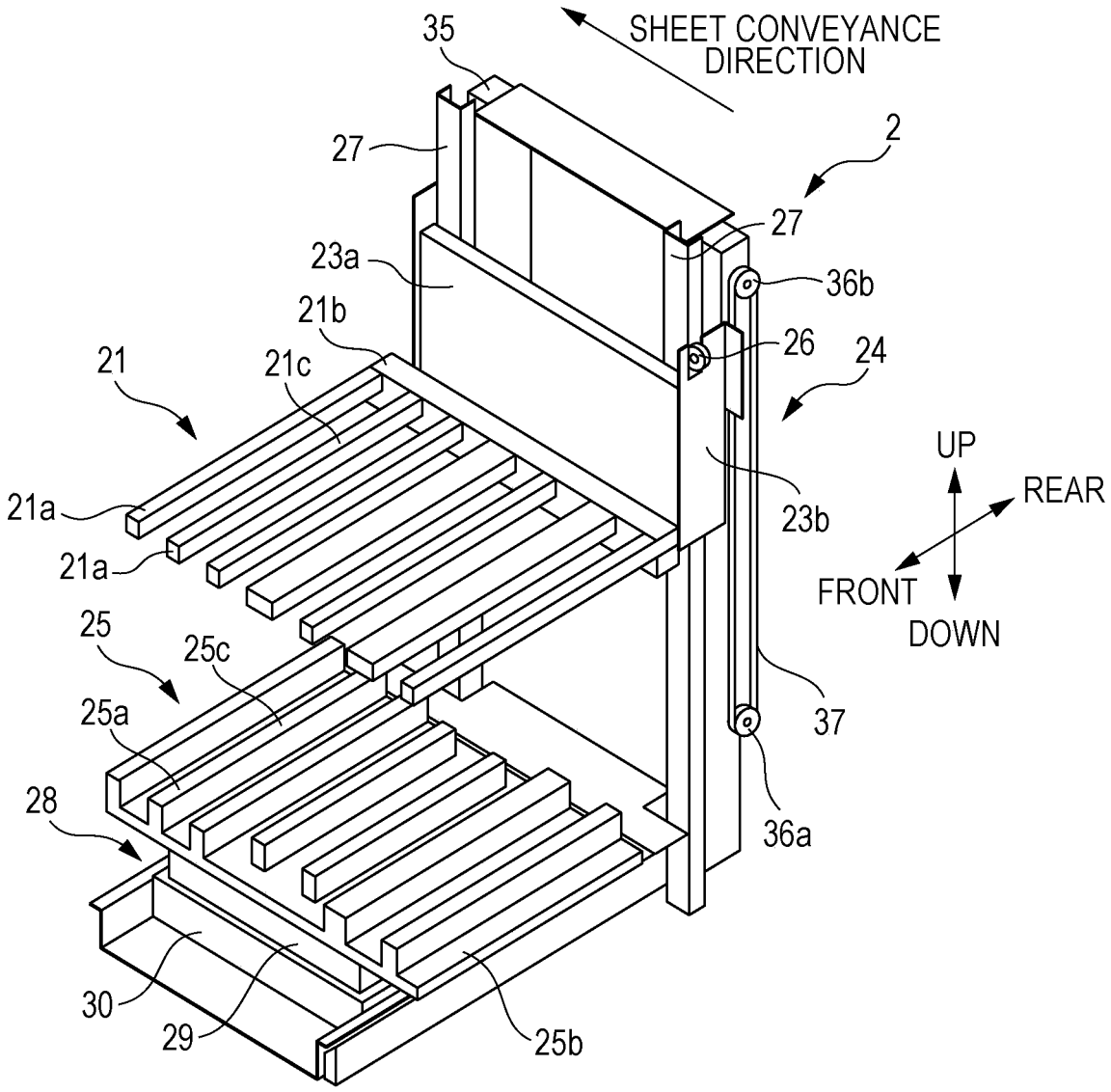
FIG. 7 is a configuration view illustrating a main part of a stacking apparatus mainly including a first tray and a second tray.

A stacking apparatus 2 includes a sheet discharge unit 20, a first tray 21 (stacker), a sheet detector 55 (recording medium detector), a stacking amount detector 56, a lifting device 24 (lifter), a second tray 25 (receiver), a front/rear drive device 28 (mover), and a stacking controller 31. FIG. 7 is a configuration view illustrating a main part of the stacking apparatus 2 mainly including the first tray 21 and the second tray 25. The configurations of the sheet discharge unit 20, the sheet detector 55, and the stacking amount detector 56 are similar to the configurations thereof in the first embodiment, and description thereof is omitted.

On the first tray 21, a sheet P that has been discharged from the sheet discharge unit 20 is stacked. The first tray 21 has a plurality of comb teeth 21*a* and a support 21*b*. The plurality of comb teeth 21*a* extends in a direction perpendicular to a sheet conveyance direction and in the horizontal direction. The plurality of comb teeth 21*a* is arranged in the horizontal direction at a predetermined pitch in the sheet conveyance direction. The plurality of comb teeth 21*a* is arranged such that upper surfaces 21*c* thereof are located on the same horizontal plane. The support 21*b* supports horizontal ends (longitudinal ends) of the plurality of comb teeth 21*a*. The support 21*b* is fixed to a base member 23*a* located on a rear side (apparatus back side).

The lifting device 24 raises or lowers the first tray 21 between a stacking position L1 at which a sheet P is stacked and a lower position L2 located below the stacking position L1. When the number of sheets P stacked on the first tray 21 reaches the set number, the lifting device 24 lowers the first tray 21 from the stacking position L1 to the lower position L2. When delivery of a sheet P from the first tray 21 to the second tray 25 is completed, the lifting device 24 raises (moves) the first tray 21 from the lower position L2 to a home position L10 (see FIG. 10A).

The second tray 25 is disposed below the first tray 21 and receives a sheet P stacked on the first tray 21 when the first tray 21 is lowered. The second tray 25 has a plurality of comb teeth 25*a* and a support 25*b*. The plurality of comb teeth 25*a* extends in a direction perpendicular to a sheet conveyance direction and in the horizontal direction. The plurality of comb teeth 25*a* is arranged in the horizontal direction at a predetermined pitch in the sheet conveyance direction. The plurality of comb teeth 25*a* is arranged such that upper surfaces 25*c* thereof are located on the same horizontal plane. Each of the comb teeth 25*a* protrudes upward from an upper surface of the support 25*b*. The plurality of comb teeth 25*a* is fixed to a surface of the support 25*b*, and the support 25*b* is fixed to a pedestal 29 of the front/rear drive device 28 described later.

Figure 8:
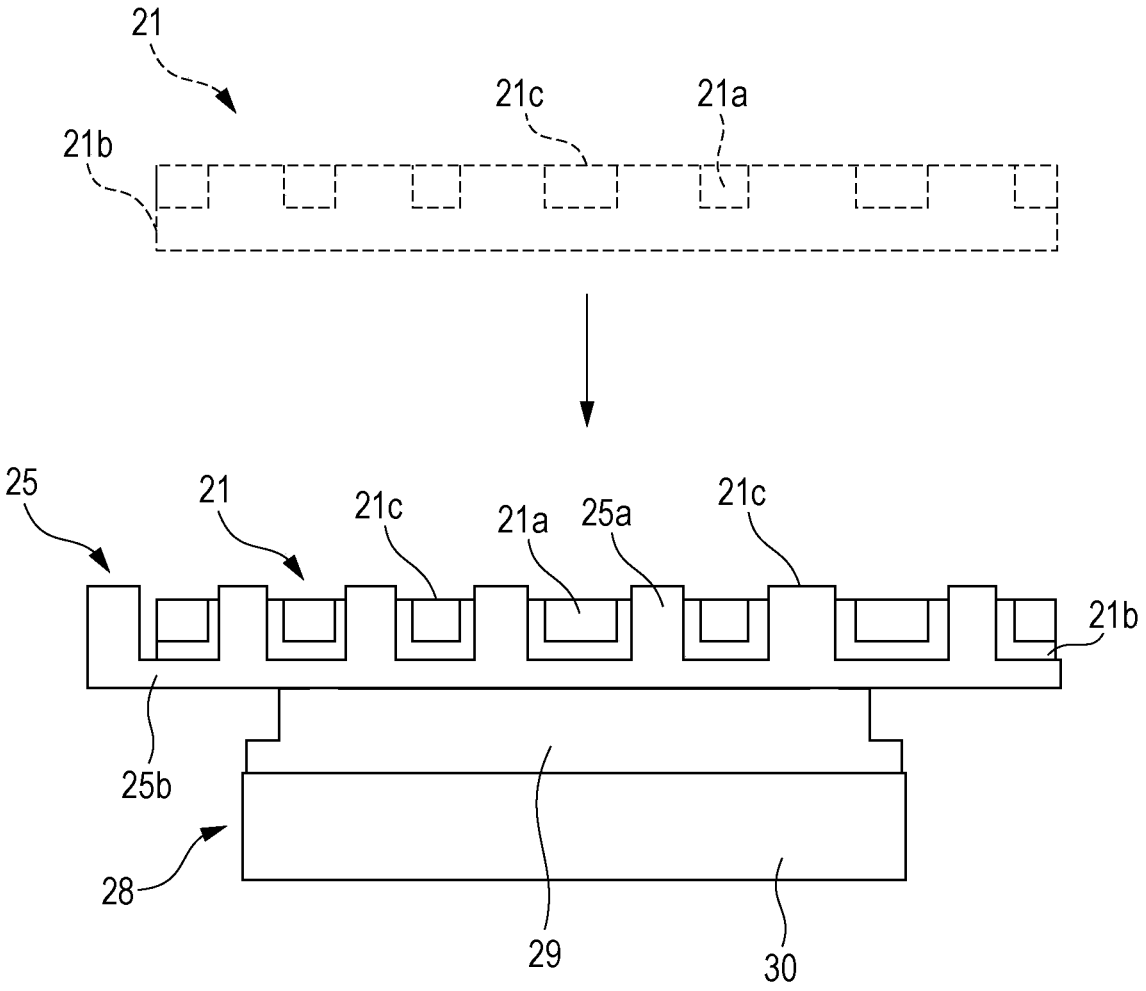
FIG. 8 is an explanatory diagram illustrating a relationship between the first tray and the second tray.

FIG. 8 is an explanatory diagram illustrating a relationship between the first tray 21 and the second tray 25. The plurality of comb teeth 25*a* of the second tray 25 is disposed at positions corresponding to spaces (gaps) between the plurality of comb teeth 21*a* formed on the first tray 21. Therefore, even when the first tray 21 moves downward and the first tray 21 and the second tray 25 exist on the same horizontal plane, the first tray 21 and the second tray 25 do not interfere with each other. That is, the first tray 21 and the second tray 25 can pass each other in the vertical direction.

With this configuration, the upper surface 21*c* of the first tray 21 is lowered below the upper surface 25*c* of the second tray 25, and a sheet P stacked on the first tray 21 can be thereby delivered to the second tray 25. The above-described lower position L2 for delivering a sheet P is determined in advance as a position where the upper surface 21*c* of the first tray 21 exists below the upper surface 25*c* of the second tray 25 according to the height of the second tray 25.

Here, the configuration will be described with reference to FIG. 7 again. The front/rear drive device 28 includes the pedestal 29 and a drive unit 30. On the pedestal 29, the second tray 25 is detachably mounted. The drive unit 30 includes a pedestal support 32 (see FIG. 10C) and a guide 33 (see FIG. 10C). The pedestal support 32 is guided by the guide 33 and can move between the lower position L2 (see FIG. 10B) inside a housing 2*a* and an outer position L3 (see FIG. 10C) outside the housing 2*a*. Therefore, the pedestal 29 on the pedestal support 32 can move in the front-rear direction by driving of the drive unit 30, and the second tray 25 on the pedestal 29 can be discharged to the outside of the housing 2*a*.

The front/rear drive device 28 disposes the second tray 25 below the first tray 21 inside the housing 2*a*. When a sheet P is delivered from the first tray 21 to the second tray 25, the front/rear drive device 28 moves the second tray 25 and the pedestal 29 to the front side, and sends out the second tray 25 and the pedestal 29 to the outside of the housing 2*a*. A user inserts a carrier 41 of the carriage 40 between the pedestal 29 and the pedestal support 32. When a user moves the carriage 40 away from the stacking apparatus 2, the second tray 25 is removed from the pedestal 29 and attached to the carriage 40. As a result, a user can convey the carriage 40 while the second tray 25 on which a sheet P is placed is mounted on the carriage 40.

Thereafter, a user removes the sheet P from the second tray 25 mounted on the carriage 40, removes the second tray 25 from the carriage 40, and attaches the second tray 25 to the pedestal 29. When the second tray 25 is attached to the pedestal 29, the front/rear drive device 28 moves the second tray 25 into the housing 2*a* and returns the first tray 21 to the home position L10. Note that the housing 2*a* of the stacking apparatus 2 has a shutter 83 (see FIGS. 10A to 10E). The shutter 83 is opened or closed in response to enter/exit of the second tray 25.

The image forming controller 19 transmits that the time is within the start-up time from the time when power that switches on/off of a current flowing in the system is switched on to the time of shifting to an image formable state as information to the stacking controller 31. When the sheet detector 55 detects a sheet P within the start-up time, the stacking controller 31 controls driving of the lifting device 24 such that the first tray 21 is lowered from the stacking position L1 to the lower position L2 and the second tray 25 receives the sheet P, and controls driving of the front/rear drive device 28 such that the second tray 25 is moved from the lower position L2 in the system to the outer position L3 outside the system.

Figure 9:
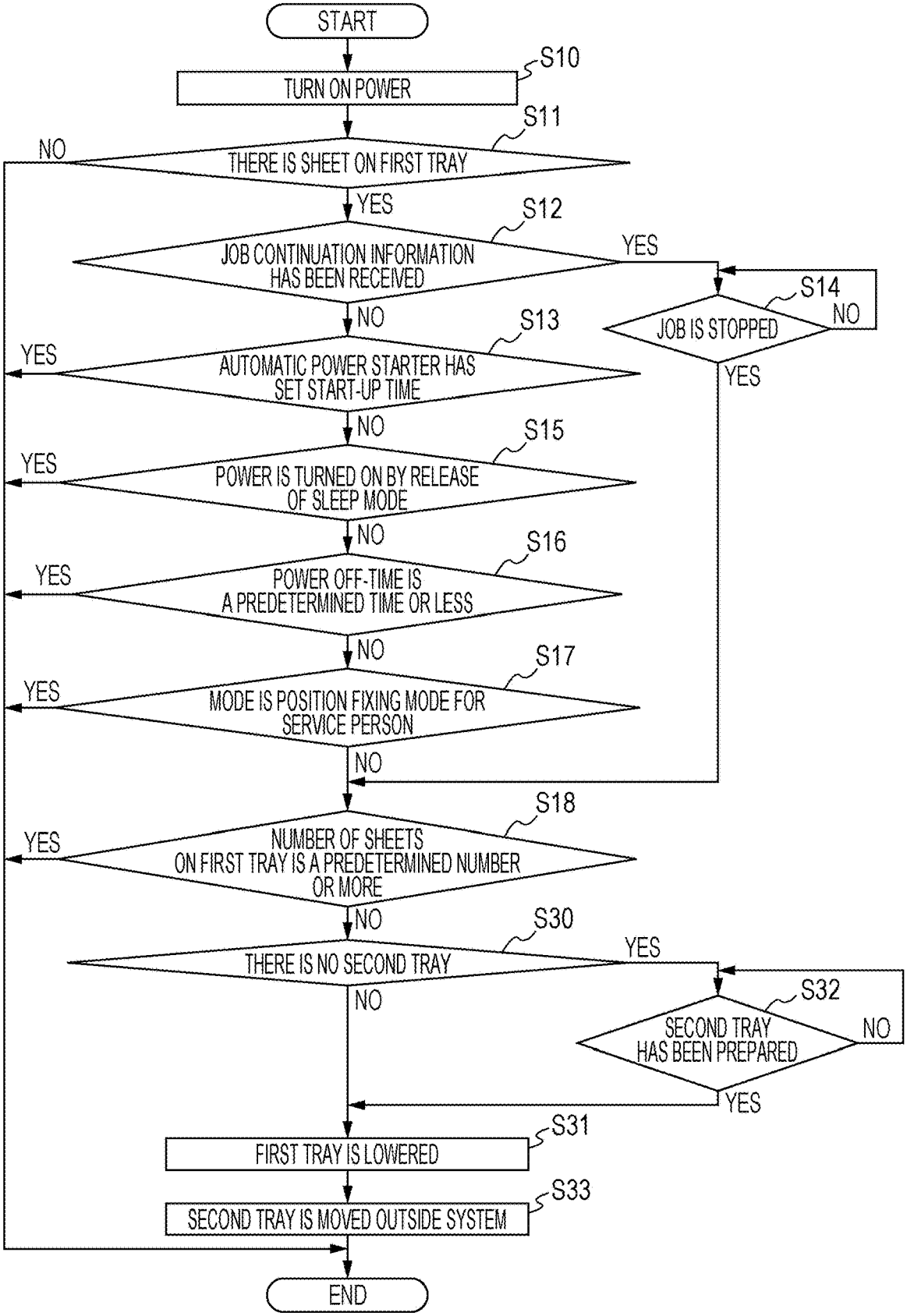
FIG. 9 is a flowchart illustrating a flow of control of a stacker and a receiver within start-up time.

FIG. 9 is a flowchart illustrating a flow of control of the first tray 21 and the second tray 25 within start-up time. FIGS. 10A to 10E are explanatory diagrams for explaining a flow of operation of the first tray 21 and the second tray 25. The processing illustrated in this flowchart is executed by the image forming controller 19 and the stacking controller 31 with a user's print start command as a trigger. S10 to S17 are described in a similar manner to FIG. 4, and therefore description thereof is omitted.

In step S18, the stacking controller 31 confirms whether the number of sheets P stacked on the first tray 21 detected by the sheet detector 55 is a predetermined number or more. If the stacking amount of sheets P on the first tray 21 is the predetermined number or more, an affirmative determination is made in step S18, and control within the start-up time is ended. Meanwhile, if the stacking amount of sheets P stacked on the first tray 21 is less than the predetermined number, a negative determination is made in step S18, and the process proceeds to step S30.

In step S30, the stacking controller 31 determines whether the second tray 25 is disposed below the first tray 21 (see FIG. 10A). If the second tray 25 is not disposed below the first tray 21, an affirmative determination is made in step S30, and the process proceeds to step S32. Meanwhile, if the second tray 25 is disposed below the first tray 21, a negative determination is made in step S30, and the process proceeds to step S31.

Figure 10A:
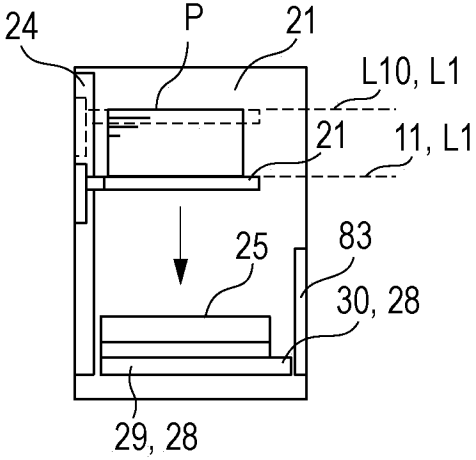
FIGS. 10A to 10E are explanatory diagrams for explaining a flow of operation of the stacker and the receiver.
Figure 10B:
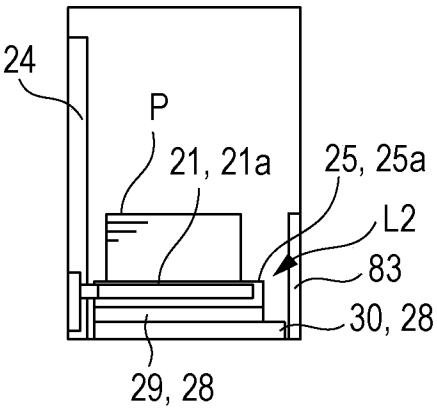
Figure 10C:
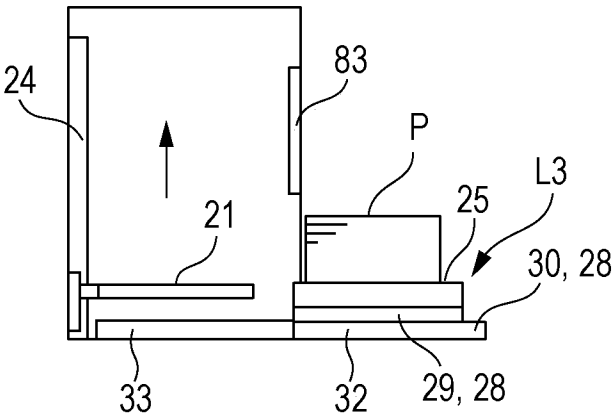
Figure 10D:
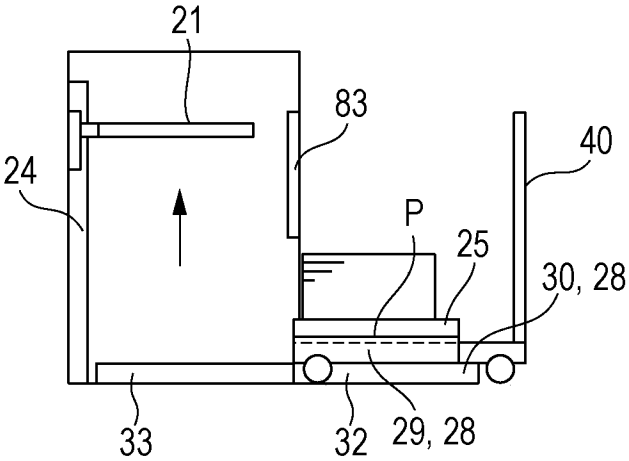
Figure 10E:
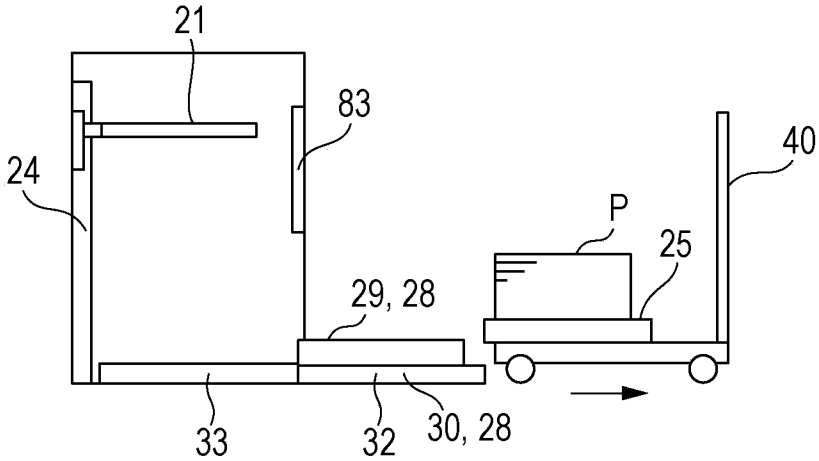

In step S31, the stacking controller 31 controls driving of the lifting device 24 to lower the first tray 21 (see FIG. 10A). The first tray 21 is lowered until the first tray 21 reaches the lower position L2 for delivering a sheet P (see FIG. 10B). The lower position L2 is set according to the height of the second tray 25 mounted on the pedestal 29. When the first tray 21 reaches the lower position L2, the upper surface 25*c* of the second tray 25 arrives above the upper surface 21*c* of the first tray 21. Therefore, a sheet P stacked on the first tray 21 is delivered from the first tray 21 to the second tray 25 (see FIG. 10B).

In step S33, the stacking controller 31 controls the front/rear drive device 28 to move the pedestal 29 forward (see FIG. 10C), and ends control in-start-up time.

Note that this forward movement is performed until the pedestal 29 and the second tray 25 are discharged to the outside of the stacking apparatus 2. Thereafter, the stacking controller 31 controls the lifting device 24 to raise the first tray 21 to the home position L10 (see FIG. 10D). Thereafter, the second tray 25 discharged to the outside of the image forming apparatus 1 is removed from the pedestal 29 while the sheet P is stacked on the second tray 25, and is attached to the carriage 40 prepared outside the image forming apparatus 1 (see FIG. 10E). A user can convey the carriage 40 while the second tray 25 on which the sheet P is placed is fixed onto the carriage 40.

Thereafter, when a user removes the sheet P stacked on the second tray 25 and the second tray 25 becomes empty, a user removes the second tray 25 from the carriage 40 and attaches the second tray 25 to the pedestal 29. When the second tray 25 is attached, the stacking controller 31 controls the front/rear drive device 28 to move the pedestal 29 backward. This backward movement is performed until the pedestal 29 and the second tray 25 mounted thereon reach the home position of the housing 2*a*. As a result, the second tray 25 is returned to the inside of the apparatus.

In step S32, the stacking controller 31 determines whether the second tray 25 is prepared. If the second tray 25 is prepared, an affirmative determination is made in step S32, and the process proceeds to step S31. If the second tray 25 is not prepared, a negative determination is made in step S32, and the process returns to step S32.

Note that the second tray 25 is preferably returned to the pedestal 29 before the number of sheets P stacked on the first tray 21 reaches the set number. When the pedestal 29 is discharged to the outside of the apparatus and is left as it is, the pedestal 29 may be impeditive. Therefore, the pedestal 29 may be returned to the inside of the apparatus before the second tray 25 is removed from the pedestal 29 and attached to the pedestal 29 again.

As described above, in the present embodiment, the image forming controller 19 recognizes a state within the start-up time from the time when power of the image forming apparatus 1 is switched on to the time when the image forming apparatus 1 is shifted to an image formable state. When the sheet detector 55 detects a sheet P within the start-up time, the stacking controller 31 controls driving of the lifting device 24 such that the first tray 21 is lowered from the stacking position L1 to the lower position L2 and the second tray 25 receives the sheet P, and controls driving of the front/rear drive device 28 such that the second tray 25 is moved to the outer position L3 outside the system. According to this configuration, even in a case where power is switched off due to a trouble such as a power failure and a sheet P remains in the first tray 21, when the power is turned on, the first tray 21 is automatically lowered, the sheet P is delivered to the second tray 25, and the second tray 25 is automatically moved out of the system. Therefore, it is possible to prevent a user from forgetting to take the sheet P.

When the continuation information receiver 62 receives job continuation information, when the off state of the power button 92 by the sleep mode unit 66 is released and the power button 92 is switched on, when the off-time measured by the off-time measurer 67 is a predetermined time or less, when the mode is a position fixing mode for a service person, or when it is determined that the stacking amount of sheets P is a predetermined amount or less on the basis of a detection result detected by the stacking amount detector 56, the stacking controller 31 controls driving of the lifting device 24 so as to keep the first tray 21 at the stacking position L1, and controls driving of the front/rear drive device 28 so as to keep the second tray 25 at a position in the system (lower position L2).

Hereinabove, the image forming system and the stacking apparatus according to an embodiment of the present invention have been described. However, the present invention is not limited to the above-described embodiments, and various modifications can be made within the scope of the invention.

For example, in the present embodiments, the control of the image forming controller 19 and the control of the stacking controller 31 are independent from each other. However, the present invention is not limited to the above embodiments. The image forming controller may include the configuration of the stacking controller 31, and the image forming controller may perform control including control of the stacking controller 31.

In the present embodiments, the stacking amount of sheets P on the first tray 21 is based on the number of sheets P stacked. However, the present invention is not limited to the above embodiments. The stacking amount of sheets P on the first tray 21 may be based on the position of the first tray 21 on which the sheets P are stacked, the height of the sheets P stacked on the first tray 21, or the weight of the sheets P stacked on the first tray 21.

In the present embodiments, it is determined that there is a sheet P on the first tray 21 within the start-up time from the time when power of the image forming apparatus 1 is switched on to the time when the image forming apparatus 1 is shifted to an image formable state. However, the present invention is not limited to the above embodiments. It may be determined that there is a sheet P on the first tray 21 within start-up time from the time when power of the stacking apparatus 2 is switched on to the time of shifting to an image formable state.

In the present embodiments, the image forming system 100 includes two apparatuses of the image forming apparatus 1 and the stacking apparatus 2. At the same time, this means that the image forming system 100 includes a component of the image former 90 and a component of the stacking apparatus 2. The present invention is not limited to the above-described embodiments, and the image forming apparatus 1 may be regarded as an apparatus including a component of the image former 90 and a component of the stacking apparatus 2.

In the present embodiments, each of the image forming apparatus 1 and the stacking apparatus 2 includes a power switch and a power button. However, the present invention is not limited to the above embodiments. The image forming apparatus 1 is connected to the stacking apparatus 2 via a cable (not illustrated). When power of the image forming apparatus 1 is switched on by operation of the power switch 91 and the power button 92 of the image forming apparatus 1, power of the stacking apparatus 2 may be switched on. Similarly, when power of the image forming apparatus 1 is switched off by operation of the power switch 91 and the power button 92 of the image forming apparatus 1, power of the stacking apparatus 2 may be switched off.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming system comprising:

an image former that forms an image;

a stacker that stacks a recording medium on which an image has been formed by the image former and which has been discharged from the image former;

a lifter that raises or lowers the stacker between a stacking position where the recording medium is stacked and a lower position located below the stacking position;

a recording medium detector that detects the recording medium stacked on the stacker;

a hardware processor that controls driving of the lifter so as to lower the stacker from the stacking position to the lower position when it is determined that the recording medium is on the stacker on the basis of a detection result of the recording medium detector within start-up time from a time when power is switched on to a time of shifting to an image formable state; and a continuation information receiver that receives job continuation information indicating that a job executed before the power is switched from on to off continues when the power is next switched on, wherein when the continuation information receiver receives the job continuation information, the hardware processor controls driving of the lifter so as to keep the stacker at the stacking position.

2. The image forming system according to claim 1, wherein the hardware processor controls driving of the lifter so as to lower the stacker from the stacking position to the lower position when the continuation information receiver receives a signal to stop the job after the power is switched on.

3. The image forming system according to claim 1, wherein the hardware processor automatically switches on the power at a predetermined time, and the hardware processor controls driving of the lifter so as to keep the stacker at the stacking position when the power is switched on by the hardware processor.

4. The image forming system according to claim 1, wherein the hardware processor automatically switches off the power when there is no user operation for a predetermined time or more, and the hardware processor controls driving of the lifter so as to keep the stacker at the stacking position when the off state by the hardware processor is released and the power is switched on.

5. The image forming system according to claim 1, wherein the hardware processor measures off-time from a time when the power is turned off to a time when the power is switched on, and the hardware processor controls driving of the lifter so as to keep the stacker at the stacking position when the off-time measured by the hardware processor is a predetermined time or less.

6. The image forming system according to claim 1, wherein the hardware processor has a position fixing mode that controls driving of the lifter so as to keep the stacker at the stacking position, and the hardware processor controls driving of the lifter so as to keep the stacker at the stacking position when the position fixing mode is selected.

7. The image forming system according to claim 1, comprising a stacking amount detector that detects a stacking amount of the recording medium stacked on the stacker, wherein the hardware processor controls driving of the lifter so as to keep the stacker at the stacking position when it is determined that the stacking amount is a predetermined amount or more on the basis of a detection result of the stacking amount detector.

8. The image forming system according to claim 1, wherein the hardware processor determines whether a carriage is disposed below the stacker, the hardware processor does not drive the lifter when the carriage is not disposed, and the hardware processor controls driving of the lifter such that the stacker is lowered to the lower position and the carriage receives the recording medium when the carriage is disposed.

9. A stacking apparatus comprising:

a stacker that stacks a recording medium on which an image has been formed by an image former that forms an image and which has been discharged from the image former;

a lifter that raises or lowers the stacker between a stacking position where the recording medium is stacked and a lower position located below the stacking position;

a recording medium detector that detects the recording medium stacked on the stacker; and a hardware processor that controls driving of the lifter so as to lower the stacker from the stacking position to the lower position when it is determined that the recording medium is on the stacker on the basis of a detection result of the recording medium detector within start-up time from a time when power is switched on to a time of shifting to an image formable state; wherein the hardware processor automatically switches on the power at a predetermined time, and the hardware processor controls driving of the lifter so as to keep the stacker at the stacking position when the power is switched on by the hardware processor.

10. An image forming system comprising:

an image former that forms an image;

a stacker that stacks a recording medium on which an image has been formed by the image former and which has been discharged from the image former;

a receiver that is disposed below the stacker and receives the recording medium stacked on the stacker when the stacker is lowered;

a lifter that raises or lowers the stacker between a stacking position where the recording medium is stacked and a lower position located below the stacking position;

a mover that moves the receiver between the lower position and a position outside the system away from the lower position in a horizontal direction;

a recording medium detector that detects the recording medium stacked on the stacker; and a hardware processor that controls driving of the lifter such that the stacker is lowered from the stacking position to the lower position and the receiver receives the recording medium, and controls driving of the mover so as to move the receiver to the position outside the system when it is determined that the recording medium is on the stacker on the basis of a detection result of the recording medium detector within start-up time from a time when power is switched on to a time of shifting to an image formable state; and a continuation information receiver that receives job continuation information indicating that a job executed before the power is switched from on to off continues when the power is next switched on, wherein when the continuation information receiver receives the job continuation information, the hardware processor controls driving of the lifter so as to keep the stacker at the stacking position, and controls driving of the mover so as to keep the receiver at a position in the system.

11. The image forming system according to claim 10, wherein the hardware processor controls driving of the lifter such that the stacker is lowered to the lower position and the receiver receives the recording medium, and controls driving of the mover so as to move the receiver to the position outside the system when the continuation information receiver receives a signal to stop the job after the power is switched on.

12. The image forming system according to claim 10, wherein the hardware processor automatically switches on the power at a predetermined time, and the hardware processor controls driving of the lifter so as to keep the stacker at the stacking position, and controls driving of the mover so as to keep the receiver at a position in the system when the power is switched on by the hardware processor.

13. The image forming system according to claim 10, wherein the hardware processor automatically switches off the power when there is no user operation for a predetermined time or more, and the hardware processor controls driving of the lifter so as to keep the stacker at the stacking position, and controls driving of the mover so as to keep the receiver at a position in the system when the off state of the power by the hardware processor is released and the power is switched on.

14. The image forming system according to claim 10, wherein the hardware processor measures off-time from a time when the power is turned off to a time when the power is switched on, and the hardware processor controls driving of the lifter so as to keep the stacker at the stacking position, and controls driving of the mover so as to keep the receiver at a position in the system when the off-time measured by the hardware processor is a predetermined time or less.

15. The image forming system according to claim 10, wherein the hardware processor has a position fixing mode that controls driving of the lifter so as to keep the stacker at the stacking position, and controls driving of the mover so as to keep the receiver at a position in the system, and the hardware processor controls driving of the lifter and the mover so as to keep the stacker at the stacking position and at a position in the system when the position fixing mode is selected.

16. The image forming system according to claim 10, comprising a stacking amount detector that detects a stacking amount of the recording medium stacked on the stacker, wherein the hardware processor controls driving of the lifter so as to keep the stacker at the stacking position, and controls driving of the mover so as to keep the receiver at a position in the system when it is determined that the stacking amount is a predetermined amount or less more on the basis of a detection result of the stacking amount detector.

17. The image forming system according to claim 10, wherein the hardware processor determines whether the receiver is disposed below the stacker, the hardware processor drives neither the lifter nor the mover when the receiver is not disposed, and the hardware processor controls driving of the lifter such that the stacker is lowered to the lower position and the receiver receives the recording medium, and controls driving of the mover so as to move the receiver to the position outside the system when the receiver is disposed.

18. A stacking apparatus comprising:

a stacker that stacks a recording medium on which an image has been formed by an image former that forms an image and which has been discharged from the image former;

a receiver that is disposed below the stacker and receives the recording medium stacked on the stacker when the stacker is lowered;

a lifter that raises or lowers the stacker between a stacking position where the recording medium is stacked and a lower position located below the stacking position;

a mover that moves the receiver between the lower position and a position outside the system away from the lower position in a horizontal direction;

a recording medium detector that detects the recording medium stacked on the stacker; and a hardware processor that controls driving of the lifter such that the stacker is lowered from the stacking position to the lower position and the receiver receives the recording medium, and controls driving of the mover so as to move the receiver to the position outside the system when it is determined that the recording medium is on the stacker on the basis of a detection result of the recording medium detector within start-up time from a time when power is switched on to a time of shifting to an image formable state;

wherein the hardware processor automatically switches on the power at a predetermined time, and the hardware processor controls driving of the lifter so as to keep the stacker at the stacking position when the power is switched on by the hardware processor.

* * * * *